US005445295A

United States Patent [19]

Brown

[11] Patent Number: 5,445,295

[45] Date of Patent: Aug. 29, 1995

[54] AUTOMATED VENDING MACHINE SYSTEM FOR RECORDED GOODS

[76] Inventor: Graham Brown, P.O. Box 12634, Scottsdale, Ariz. 85267

[21] Appl. No.: 822,546

[22] Filed: Jan. 17, 1992

[51] Int. Cl.[6] ..... G07F 11/00

[52] U.S. Cl. ..... 221/3; 221/9; 235/381

[58] Field of Search ..... 221/9, 10, 11, 3, 17, 221/DIG. 1; 235/381, 375, 383, 385

[56] References Cited

U.S. PATENT DOCUMENTS

| | | | |
|---|---|---|---|
| 2,686,583 | 8/1954 | Marder | 194/74 |
| 3,780,907 | 12/1973 | Colburn et al. | 221/2 |
| 3,826,344 | 7/1974 | Wahlberg | 194/2 |
| 4,300,040 | 11/1981 | Gould et al. | 235/381 |
| 4,414,467 | 11/1983 | Gould et al. | 235/381 |
| 4,695,954 | 9/1987 | Rose et al. | 364/413 |
| 4,818,854 | 4/1989 | Davies et al. | 235/381 |
| 4,839,505 | 6/1989 | Bradt et al. | 235/381 |
| 4,995,498 | 2/1991 | Menke | 194/205 |
| 5,028,766 | 7/1991 | Shah | 235/381 |
| 5,039,848 | 8/1991 | Stoken | 235/381 |

*Primary Examiner*—Kenneth W. Noland
*Attorney, Agent, or Firm*—Peter C. Warner; Steven G. Lisa

[57] ABSTRACT

An unattended vending machine for the sale of articles such as compact audio cassette tapes, video cassette tapes, electromagnetic or electro-optical storage devices, or any other device capable of storing recorded information for subsequent reproduction by a patron. The machine displays the various disks or cassettes available, for customer purchase, and is also capable of playing extracts or complete sections of audio or audio-visual entertainment from the available disks or tapes on a video screen or audio speaker. Communications capability is available for transmitting pricing, accounting, and alarms, and for verifying credit cards, and a centralized automatic-ordering system permits reduced human intervention, and the maintenance of high levels of sales with a minimum inventory.

15 Claims, 7 Drawing Sheets

AUTOMATED VENDING MACHINE SYSTEM FOR RECORDED GOODS

BACKGROUND OF THE INVENTION

This invention relates generally to the fields of vending machine and jukebox technology. Numerous vending machines have been invented for distributing a wide variety of vended goods. Some vending machines have included mechanical manipulation devices suitable for vending objects of the size and character of records, tapes, or other audio or audio-visual storage devices. For example, U.S. Pat. No. 2,686,583, issued to Marder on Aug. 17, 1954, discloses a vending machine for phonograph records. U.S. Pat. No. 4,995,498, issued to Menke on Feb. 26, 1991, discloses a vending machine suitable for vending video cassettes. U.S. Pat. No. 5,028,766, issued to Shah on Jul. 2, 1991, discloses an unattended automated machine suitable for renting video cassettes. Each of the above patents is incorporated by reference. In addition, a wide variety of machines are available for acting as "jukeboxes," which are capable of playing selections from recorded musical information for pay.

The need exists, however, for an automated vending device that is both suitable for vending audio or audio-visual storage devices such as compact disk or cassettes, and is capable of presenting to the user, through audio or audio-visual means, a selection or sampling of recorded information, such as from the goods being vended. The need also exists for a central-controlled device with automatic ordering and resupply capability.

It is, therefore, an object of the invention to provide a machine for the display and automatic vending of audio and audio-visual storage devices and associated packaging.

It is another object of the invention to provide an improved means of sampling portions of or information about recordings such as compact disks, laser-disks, and videotapes.

It is another object of the invention to provide a system of remote monitoring and control of vending machines.

It is another object of the invention to provide a system of monitoring, storage, and analysis of data about customer interest in vended goods.

It is another object of the invention to provide a vending machine containing flexible marketing and product-dispensing characteristics.

It is another object of the invention to provide a system for automatic accounting and restocking of vending machines.

Those and other objects of the invention are provided in the present invention, which discloses an unattended vending machine capable of displaying audio or audio-visual storage devices for sale and capable of playing extracts or samples from the vended wares or other recordings associated with the vended wares, such as a music video associated with a music recording. In a preferred embodiment, the invention includes a machine for selectively displaying, on a video screen together with switchable loudspeakers, portions of the recorded information or entertainment programs. The machine also includes vending technology suitable for offering for sale the audio or audio-visual storage devices. In one form of that embodiment, the machine includes a cabinet with a large display screen at the top. When vending video tapes or compact disk recordings, for example, the screen may show a music video associated with the audio recording or a selection or "trailer" associated with the videotape being offered. A control panel permits the operator of the machine to disable the external speakers, enable the use of headphone jacks, and control the sound volume. A "sampler" button permits the potential customers to select which audio-visual display they wish to sample. The operator has the option of charging for the sampling, in which mode the machine operates in a similar fashion to a standard jukebox.

After observing the sample display, the customer may wish to use the vending device to purchase the vended wares. To that end, there is a bank-note verifying device, a coin sorter, and a credit-card reader built into the cabinet of the preferred embodiment.

An internal modem connected to the vending machine permits immediate verification of submitted credit cards as well as immediate alteration of the pricing of the goods and transmittal of accounting, sampling, or sales information. The modem also permits transmittal of tamper alarms to an alarm-monitoring service.

An alternative embodiment of the invention substitutes speakers and headphone jacks for the visual display, providing a simpler and less expensive version of the device, which is suitable for use only with musical or other audio recordings. In yet another form, the alternative embodiment is accompanied by a television receiver, a cable monitor, or a videocassette player, which plays related music videos, either prerecorded or from a service, such as the "MTV" cable channel. The sampling feature, in that combination, operates using the headphone jacks independently from the display on the screen.

Another aspect of the invention embodies a central system connected via modem to the various units of the vending devices. The central system is capable of monitoring the sales and sampling requests made by each machine, downloaded through modem from storage devices located at each machine. Based on those collected sales and sampling data, the central system is capable of automatically calculating and placing restocking orders for direct shipment to the machine operators and preparing marketing data.

Other aspects of the invention will be appreciated by those skilled in the art after a reading of the detailed disclosure of the present invention below.

DESCRIPTION OF THE DRAWINGS

The novel features of this invention are described with particularity in the claims. The invention, together with its objects and advantages, are better understood after referring to the following description and accompanying figures. Throughout the figures, the same reference numerals refer to the same elements.

DETAILED DESCRIPTION

Figure 1:
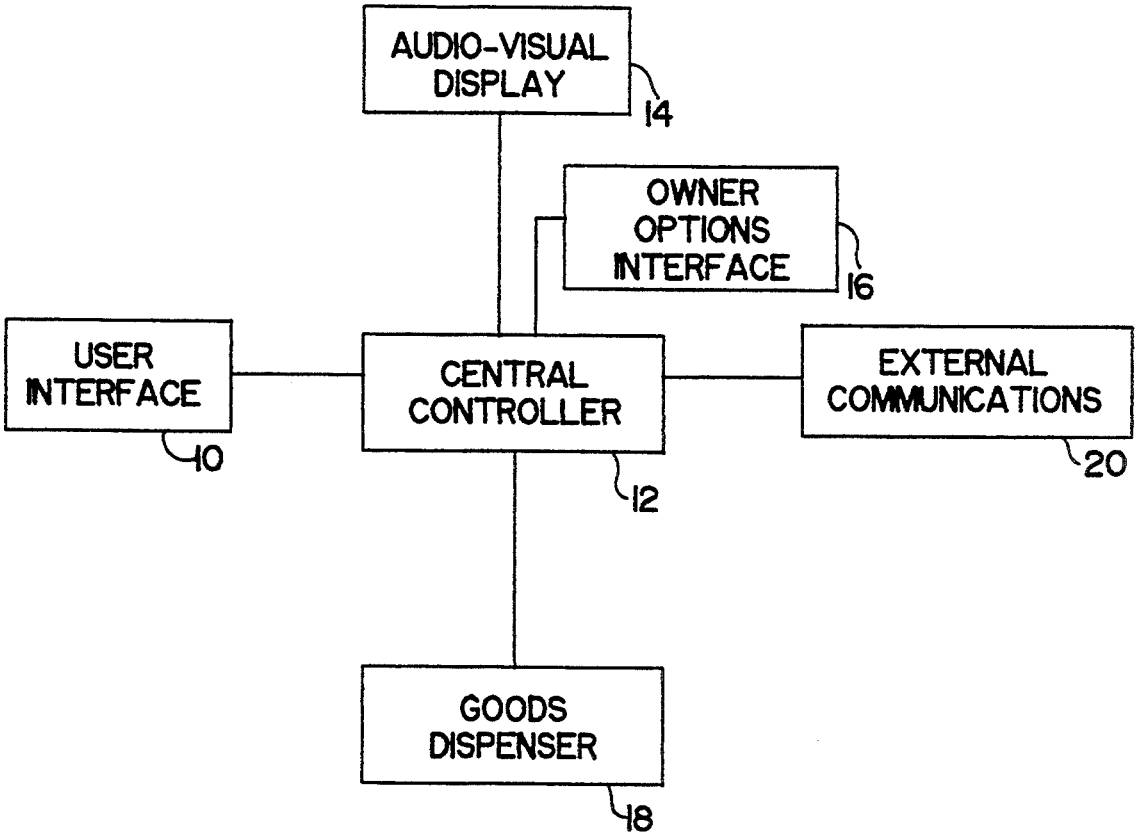
FIG. 1 depicts, in simplified schematic form, a block diagram showing the various components of an embodiment of the invention and the related communication links.

FIG. 1 shows a general system schematic illustrating the major functional units of a preferred embodiment of the invention. Patrons interact with the device through user interface 10. Central controller 12 evaluates the selections inputted through the user interface and also controls the remaining functions. Audio-visual display 14 can display a "music video" presentation containing all or part of the recordings of the compact disk being vended, or a "trailer" from the entertainment recordings on the videotapes or videodisks being vended. The machine owner can limit certain aspects of the presentation by selecting certain options on owner options interface 16, which should be located in a place inaccessible to the customers, such as the interior of the locked machine or remotely connected to the machine. When a customer selects goods for purchase, goods dispenser 18 releases the goods after central controller 12 verifies that user has paid for the purchase through the interaction with user interface 10. External communications device 20 enables the unit to communicate with remote locations via built-in modem, such as for the purpose of verifying credit cards, downloading accounting or sampling data, or indicating the need to restock the machine.

Figure 2:
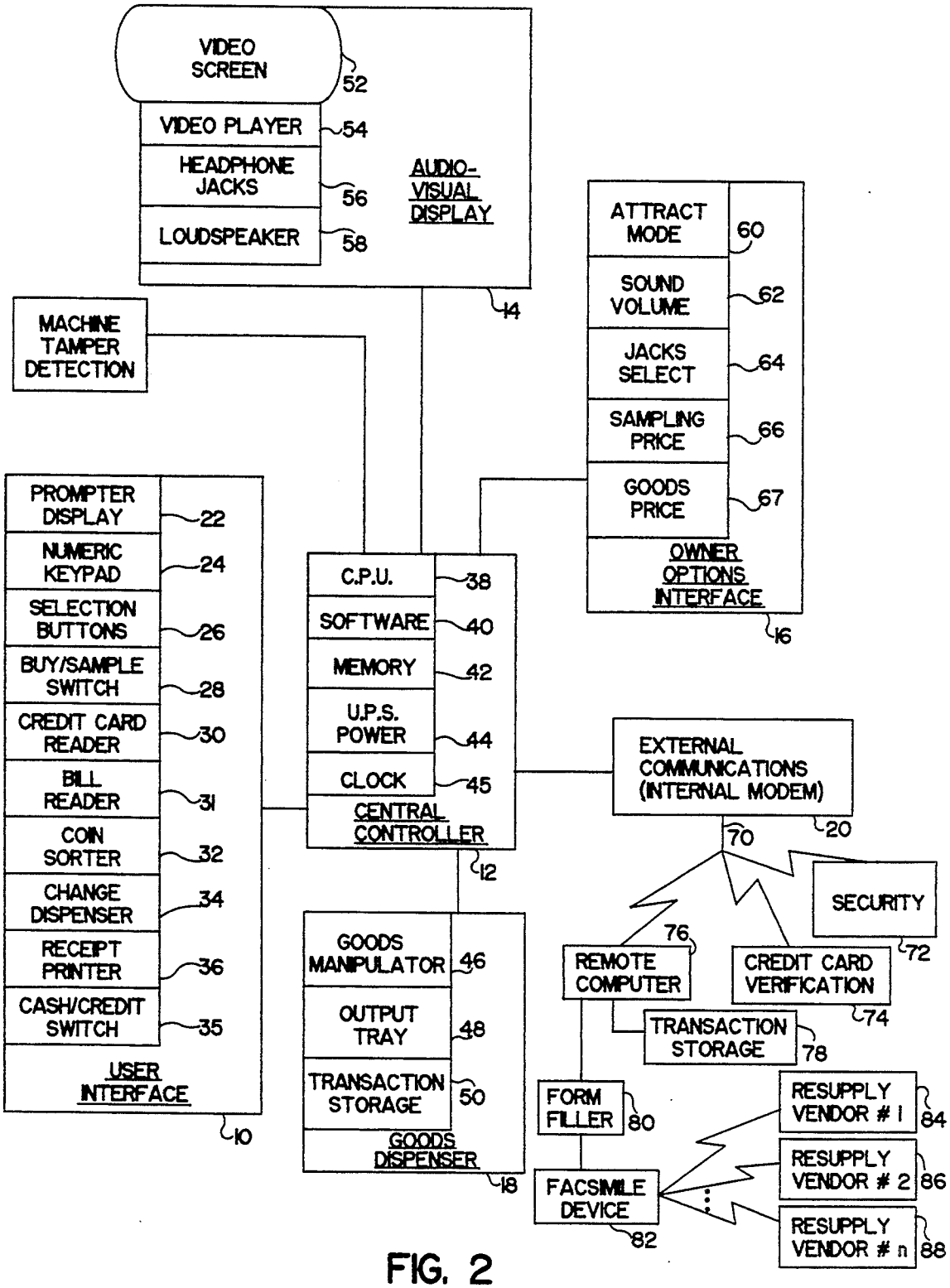
FIG. 2 is a more detailed block diagram of an embodiment of the invention.

FIG. 2 shows a more detailed schematic, which describes certain functions performed by the various major functional units in additional detail. User interface 10, previously described, contains a series of modules. First, prompter display 22, which may be a monitor screen or an LCD display, prompts the user to enter information and explains the machine's status during the purchase process. Numeric keypad 24 permits the user to type in information such as personal identification number ("PIN number") in response to a prompt or to select the number of purchases, etc. Selection buttons 26 include at least one button associated with every product being sold by the machine. If desired, the software can operate such that selection buttons 26 may be omitted in favor of a numeric entry made on numeric keypad 24. At least one selector 28 serves as a switch permitting users to elect whether they wish to purchase or merely preview a sample of the goods contained in any vending machine window.

Credit card reader 30 includes a device, as known in the art, to read the magnetic information encoded on standard credit or debit cards. Bill reader 31 and coin sorter 32 are standard devices in the art for manipulating and verifying currency. Change dispenser 34 permits refunds of excess currency after the purchase is consummated. U.S. Pat. No. 3,826,344, issued to Wahlberg on Jul. 30, 1974, which is incorporated by reference, provides details of example bill, coin, and credit-card manipulators suitable for use in this embodiment. Any combination of credit card and currency readers, 30, 31, 32, and 34, may be utilized, as the system is not dependent on what form of payment system is selected. Assuming both credit card and currency are acceptable, however, cash/credit switch 35 permits the user to select a preferred form of payment.

Receipt printer 36 prints a customer receipt for purchases of the goods. Receipt printer 36 should not print a receipt when the machine is used in the "jukebox" mode described above.

Central controller 12 contains an appropriate microcomputer central processing unit 38 such as the iAPX 8088 manufactured by the Intel Corporation. Control programs, to be described in further detail below, are stored as software 40 in read only memory ("ROM") contained on a central controller circuit board. Random access memory 42 is available to the controller for use as temporary storage during software operations. Central controller 12, as well as the remainder of the vending device, is connected to a suitable power source such as uninterrupted power supply 44, which comprises some form of battery backup to avoid loss of data during power outages. Central controller 12 also includes clock circuit 45, whose purpose is described below.

Goods dispenser 18 includes a mechanical device for the manipulation of the dispensed product, goods manipulator 46, which may be of any sort of vending mechanism. For example, the mechanical system of U.S. Pat. No. 4,995,498, issued to Menke on Feb. 26, 1991, which is incorporated by reference, discloses a computer-controlled transporting device to permit vending of video cassettes. Goods dispenser 18 also includes an output tray 48, accessible to the customer for receiving purchased goods. Goods dispenser 18 also contains a storage device, transaction storage 50, suitable for retaining data for a period of time. Transaction storage device 50 comprises an array of battery-backed up random access memory ("BRAM") or another suitable storage device, such as those used in connection with personal computers.

Audio-visual display 14 contains video screen 52, either a standard television-type monitor or a suitable flat-screen or similar display. Video player 54 is connected to video screen 52 and comprises one or more standard video cassette players or a laser-type videodisk player, with an interface circuit operable to permit electronic control, via the user interface built into the player. The device sold by High Level Marketing of Los Angeles as a "CD Listening Station" provides an example of one suitable interface circuit.

In an audio-only embodiment, an audio-only player, such as a standard home compact disk player, substitutes for video player 54. In some systems, player 54 includes a recording changing device, which permits selection among several record members, such as commercially available CD changers. In those systems, the changer might include one complete copy of each recording device sold in the machine. In another system, player 54 comprises a videodisk player with sufficient storage capability to permit recording of all sample programs, one for each type of goods sold by the vending machine, on a single recording member. In that event, a single videodisk correlated to the wares offered by the vending machine is manufactured periodically and distributed with the product, thereby permitting change of sample material to correlate with changes in the mix of merchandise.

In the preferred embodiment, audio-visual display 14 also includes a number of audio headphone jacks 56, which are essentially standard ports connected to the output of the video player to permit users to listen to the program by plugging in their own headphones. Alternatively, remote external loudspeakers, for example in soundproof booths, can be substituted for jacks 56. Although two jacks 56 are shown, any number is possible. Alternatively, headphone jacks 56 can be replaced by built-in headphones, although for reasons of expense and hygiene, that solution is not preferred. User interface 10 and software 40 in central controller 12 can be configured to accommodate multiple users, permitting customers to select both a program, using selection buttons 26 or numeric keypad 24, and a particular one of the headphone jacks 56. If video player 54 includes several different playback units, an equal number of patrons could play different programs simultaneously through different headphone jacks 56.

Loudspeaker 58 permits audio monitoring outside the machine without use of headphones. Again, any combination of headphone jacks 56 and loudspeaker 58 is permitted.

Using owner options interface 16, the owner of the machine can set certain options, tailoring the audio-visual display to the location and circumstances. Interface 16 is located, in one embodiment, inside the locked vending machine, to prevent customer access to those switches. Optionally; interface panel 16 can be located in a remote site and connected to a memory storage in the vending machine via modem. Interface panel 16 includes, for example, a switch 60 permitting the owner to define what will be displayed or played during "attract mode," when no user is operating the machine. In the embodiment in which video player 54 includes a videodisk containing several alternative programs for use to attract customers, such as advertisements, instructions on operating the machine, or simply a random selection of programs, the switch 60 permits selection among those alternatives. In the alternative embodiment in which video screen 52 connects to a television receiver or a cable station playing "MTV," attract mode selector 60 permits the owner to enable that connection.

Sound volume selector 62 permits the owner to control the volume emanating through loudspeaker 58. Indeed, for placement in some locations, the owner may desire that loudspeaker 58 be disabled entirely, which could also be accomplished with sound volume selector 62.

Jacks selector 64 permits an owner to enable or disable the headphone jacks 56. When headphone jacks 56 are enabled using jacks selector 64, the operator may set the sound volume at a predetermined level, or the operator may elect to permit customer control of headphone jacks 56 through associated sound controls (not shown). In an alternative embodiment, users can select sound volume with user interface 10.

Sampling price selector 66 permits the owner to set a price, if desired, for the operation of selection buttons 26. If the owner selects a sampling price using selector 66, the machine will operate as a combination jukebox and vending machine. If, on the other hand, the owner desires to permit free sampling, the device will operate solely as a vending machine, with the sampling mode being used merely as a promotional opportunity to attract customers. Similarly, goods price selector 67 permits the owner to set a price for the purchase of the vended goods. Other options may be added to the owner options interface as needed or desired, some of which are suggested below.

Machine tamper detection module 68, not shown in FIG. 1 but shown in FIG. 2, comprises any of a number of devices designed to discourage or resist tampering with the machine, including a device responsive to machine tilting such as used in pinball machines or a simple circuit that identifies when the machine is opened without proper use of a key. When machine tamper detection circuit 68 indicates an alarm condition, central controller 12 is programmed to transmit the alarm, subject to owner's option, (1) over loudspeaker 58 in the machine, or (2) to external communications module 20, which includes an internal modem, which passes the alarm through a standard phone line 70, to an alarm monitoring service or other security 72. Owner options interface 16 permits entry of the appropriate telephone number, or a default number can be selected for preprogramming in software 40, stored in ROM.

External communications module 20 is also used during purchase transactions using credit cards. When credit card reader 30 is enabled in the course of a purchase, central controller 12 signals modem 20 to dial one of a number of credit card verification computers 74. An approval code transmitted back through telephone line 70 to modem 20 will signal central controller 12 to permit the transaction to proceed, while a negative response will cause central controller 12 to abort the transaction and display an appropriate message on prompter display 22. An alternative embodiment employs a system of comparing with a downloaded, locally stored list of cards, such disclosed by U.S. Pat. No. 3,696,335 issued to Lemelson on Oct. 3, 1972, which is incorporated by reference.

Modem 20 is also used for pricing, whereby prices are downloaded from remote computer 76 to a price storage memory associated with selector 67 in owner options interface 16. That system permits quick price changes. The system may be complemented by adding LCD displays below each of the product windows 90.

Modem 20 is also used for diagnostic testing, to permit a central operator or the central computer to test if the machine is operating properly. If not, modem 20 serves, in certain cases, as a means for downloading corrective data.

Modem 20 is also used for accounting functions. For example, software program 40 monitors clock 45 and establishes a connection at a specified time of day from modem 20 through telephone line 70 to remote computer 76, located at a central location. At the appointed time, which might be set at night when the premises are closed, the vending unit places a call to remote computer 76, or remote computer 76 polls the machine, for the purpose of downloading the contents of transaction storage 50, representing the transactions made since the last accounting session. Stored in the contents of transaction storage 50 and communicated via modem 20 are records of sales made by the machine as well as sampling selections requested by patrons.

Remote computer 76 collects information in that fashion from a series of the vending units, perhaps at different times for each unit. Remote computer 76 stores the data downloaded from each vending machine in its associated transaction storage 78. In an alternate embodiment, modem 20 is programmed to establish a connection to remote computer 76 immediately upon the software recognizing that a type of vended ware is out of stock.

In a fully automated system, remote computer 76 includes a form printer 80, of the sort disclosed in U.S. Pat. No. 3,872,482 issued to Lemelson on Feb. 16, 1973, which is incorporated by reference. Remote computer 76 also includes an internal facsimile device 82, of the sort sold by several computer vendors under the generic name "FAX boards." Computer 76 is programmed to complete an appropriate form using form filler 80 and to transmit an image of that form using facsimile device 82 to resupply vendors 84, 86, and 88, such as record or tape companies, when the stock available to the owner of the system is low.

Such an automated ordering system permits, without significant human intervention, automatic and prompt resupply of popular goods being vended by the group of vending machines. The system also permits the machine or the machine's operator to maintain lower than normal inventory, because of the prompt restocking permitted. Moreover, by use of remote computer 76 and form filler 80, the system creates the appropriate forms instructing resupply vendors 84, 86, or 88 to ship specified product directly to the location of the vending machine, thereby avoiding having any individual vending machine owner run out of popular items and eliminating the need for intermediate shipment or warehousing.

Figure 3:
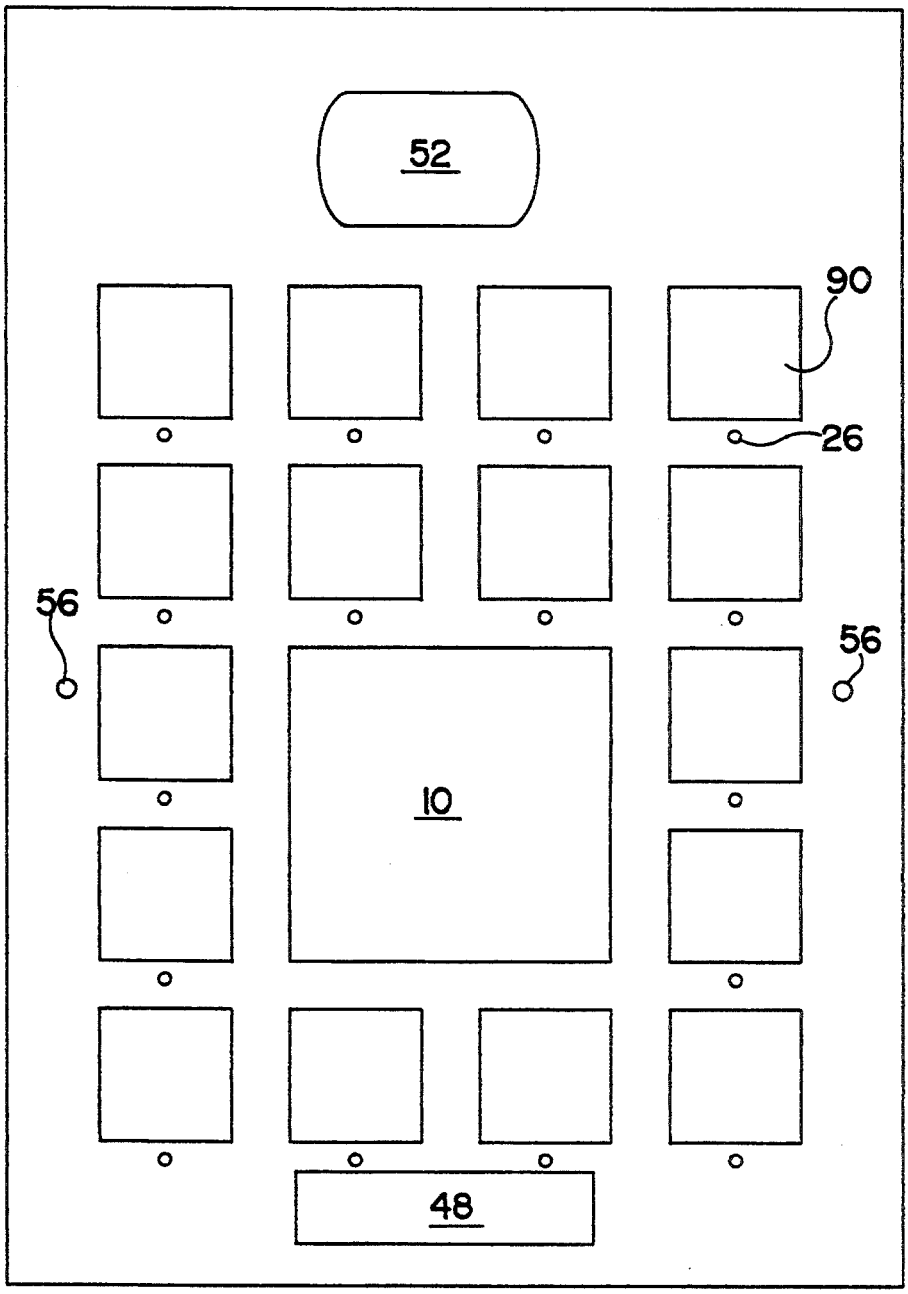
FIG. 3 is a simplified front view of an embodiment of the invention.

FIG. 3 shows a front view of one embodiment of the invention. At the top of the vending machine is video screen 52. One or more headphone jacks 56 are shown on each side of the machine, although they can be arranged in other numbers or locations. A plurality of clear windows 90, perhaps made of plastic, each display one of the type of goods offered. The front panel of the machine opens, upon activation of a lock (not shown), by swinging on hinges (also not shown). When restocking the machine, the operator fills a bin behind each window 90 and places a unit of the goods in a suitable slot behind window 90, so that the packaging of the goods is visible as the display.

Below each display window 90 is one of selection buttons 26. User interface 10 is shown in outline at the center of FIG. 3, although the details are omitted. User interface 10 may be arranged in a partially tilted or recessed panel. Product output tray 48 is shown at the bottom center of FIG. 3.

Figure 4:
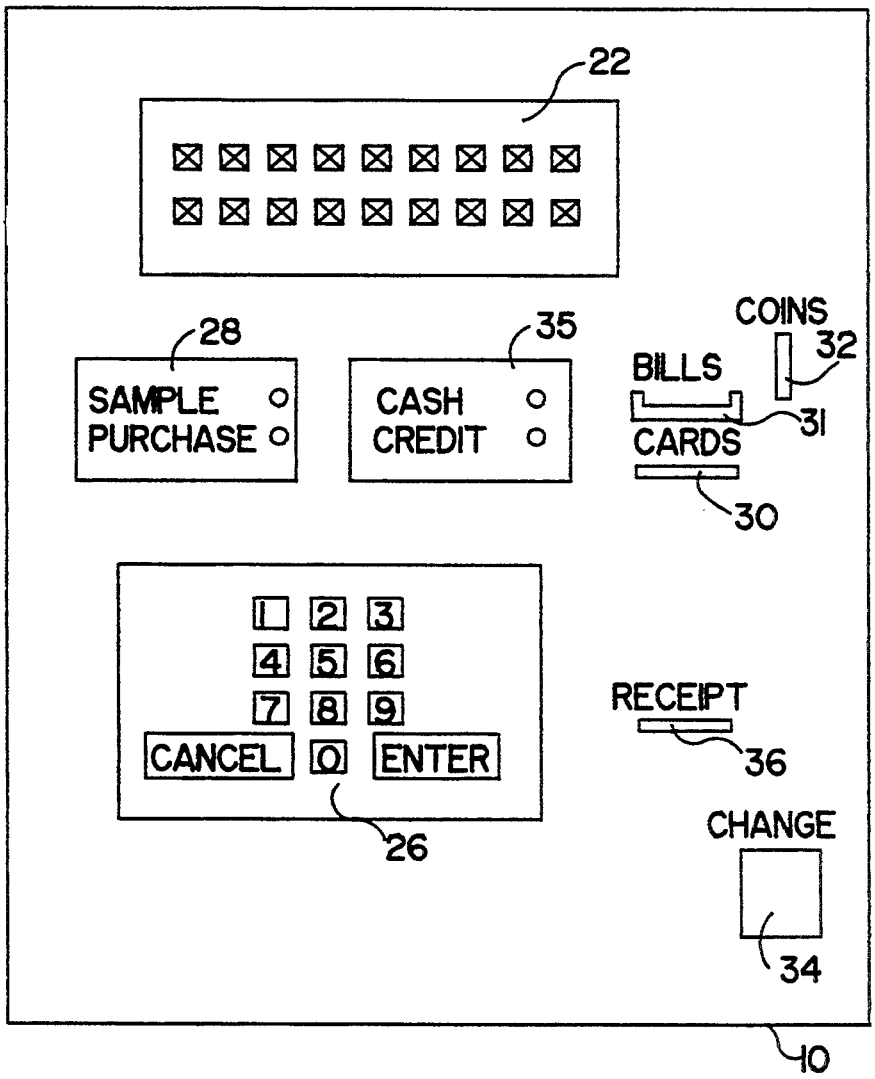
FIG. 4 shows a close-up view of the front panel of an embodiment of the invention, showing an example user interface.

FIG. 4 shows in additional detail a preferred embodiment of user interface panel 10. Two-line LCD prompter display 22 displays messages generated by software programs 40 according to the flowcharts described in FIGS. 5 and 6 below. Credit card 30, bill reader 31, and coin slot and sorter 32 permit the customer to obtain credit for purchase of wares vended by the machine, which credit would be displayed on prompter display 22. In an alternative and preferred, although more expensive, embodiment, prompter display 22 is replaced by a small monitor similar to the sort used in a bank automated teller machines.

In the embodiment illustrated in FIG. 4, cash/credit switch 35 is shown as a group of two buttons. The two buttons flash in alternating sequence when neither is depressed, to indicate the need to select one of the two options. Similarly, buy/sample switch 28 is shown as another pair of flashing buttons, which permits the patron to select whether to obtain a sample of a particular goods or purchase the product. After the customer operates buy/sample switch 28, prompter 22 requests identification of the product choice, and the customer punches one of the selector buttons 26 or enters unique number identified with one of the product windows 90 on numeric keypad 24. At the conclusion of the transaction, receipt printer 36 dispenses a receipt and, for cash transactions, change dispenser 34 returns any change due.

Figure 5:
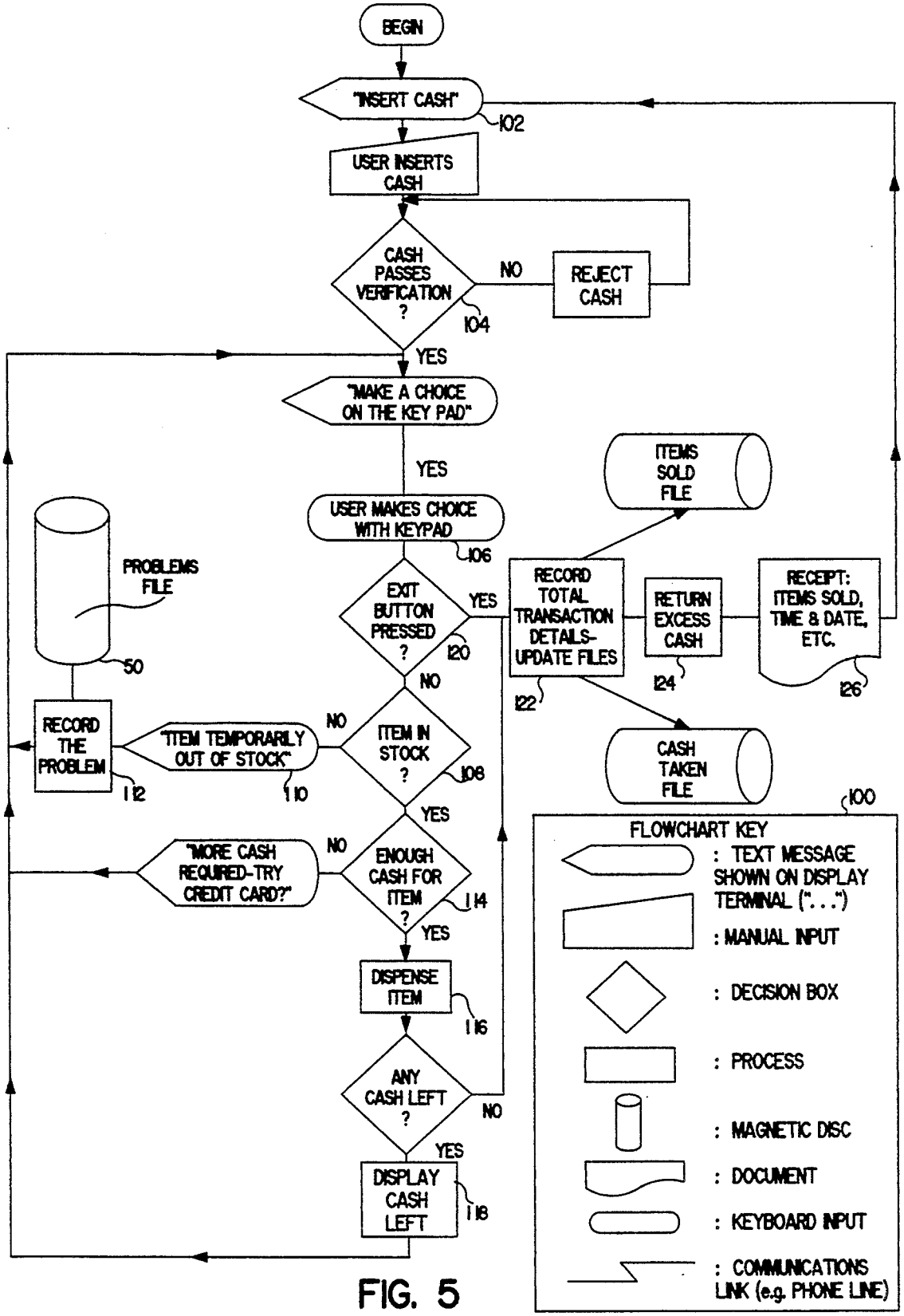
FIG. 5 shows an example flowchart illustrating the logical steps performed by programs in the device during a cash transaction by a patron using the device.

FIG. 5 illustrates a sample flowchart programmed in software 40 for use when switch 35 is set for cash transactions. Flowchart key 100 shows the coding used in FIGS. 5, 6, and 7. When switch 28 is in "purchase" mode and switch 35 indicates a cash transaction, central controller 12 implements the program illustrated in FIG. 5.

First, prompter display 22 displays a request, 102, for the user to insert cash. Assuming the user complies, bill reader 31 and coin sorter 32 attempt to verify and count the cash, 104. Prompter display 22 then prompts the user to choose a quantity and type of goods desired, 106.

The software next tests the machine's stock to determine whether sufficient desired units of the product are present. The software in the machine performs that test arithmetically; by keeping track of the number of units added to and sold from the machine. An alternative embodiment uses an electronic switch set in the bin mechanism behind each display window 90 to determine when a bin is empty. If the item is out of stock, prompter display 22 displays the appropriate message, 110, and central controller 12 records the problem, 112, in a section of storage allocated to identify problems, such as part of transaction storage 50. If the item is in stock, the software tests the amount of cash inserted against the selected item's price, 114. If the payment is deficient, prompter display 22 provides an appropriate message, otherwise goods manipulator 46 dispenses the item, 116, on output tray 48 and displays any remaining payment credits, 118, on prompter display 22.

Next, the software provides an opportunity for the patron to select another item. The operator can use the pricing software to provide multiple-purchase or other special discounts. If the user indicates that no additional purchase is desired, 120, data about the sales made during the transaction and the cash taken are recorded, 122, in transaction storage 50. Finally, change dispenser 34 returns excess cash, 124, and receipt printer 36 prints an appropriate receipt, 126, after which the software returns to its initial state.

Figure 6:
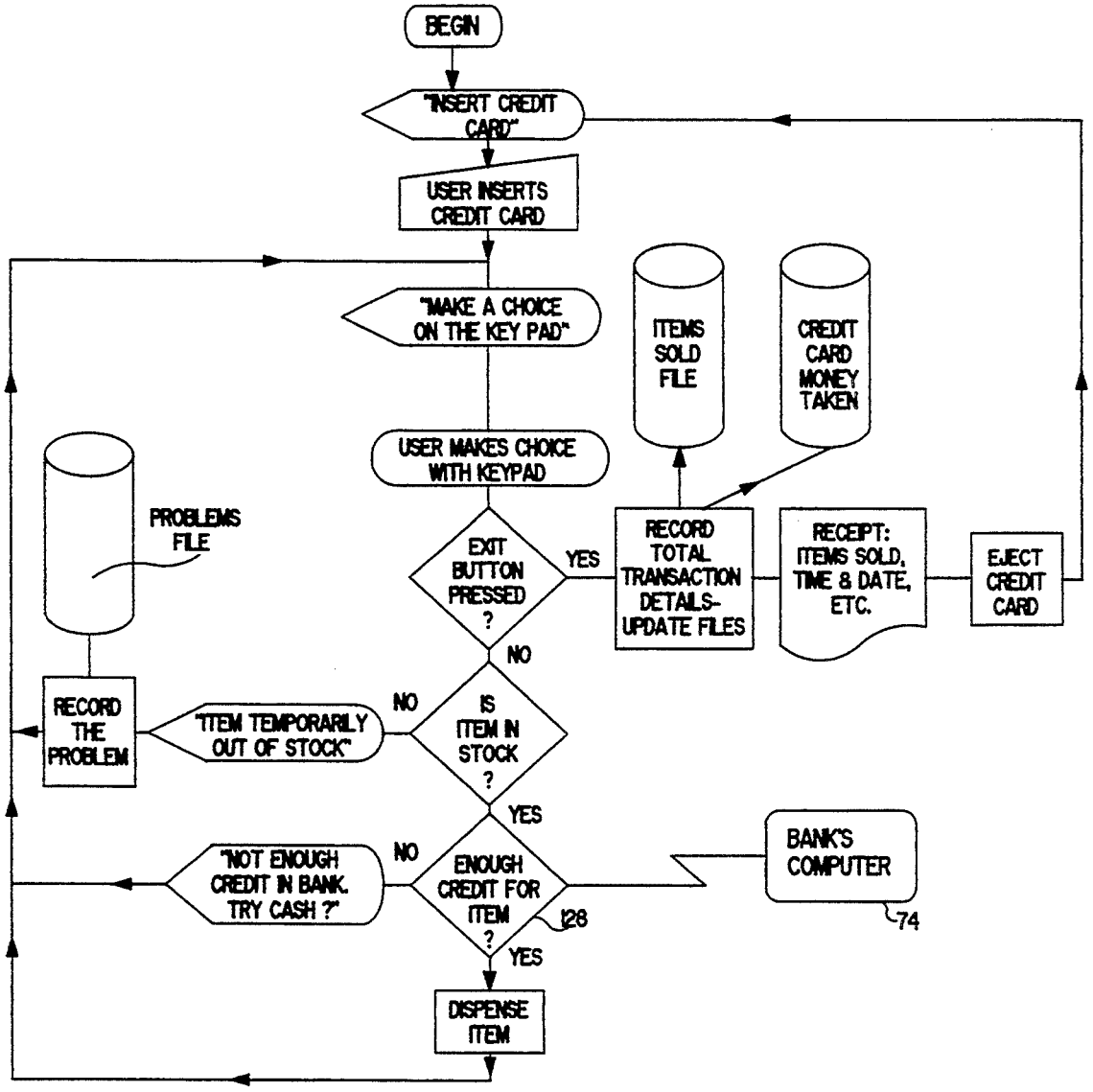
FIG. 6 shows an example flowchart illustrating the logical steps performed by programs in the device during a credit card transaction by a patron using the device.

FIG. 6 shows a similar flowchart, designed for operation when switch 35 is in the "credit card" position. The program operates virtually identically to FIG. 5, except the credit check, 128, is implemented by central controller 12 instructing modem 20 to place a telephone verification call on telephone line 20 to credit card verification computers 24 (see FIG. 2).

Figure 7:
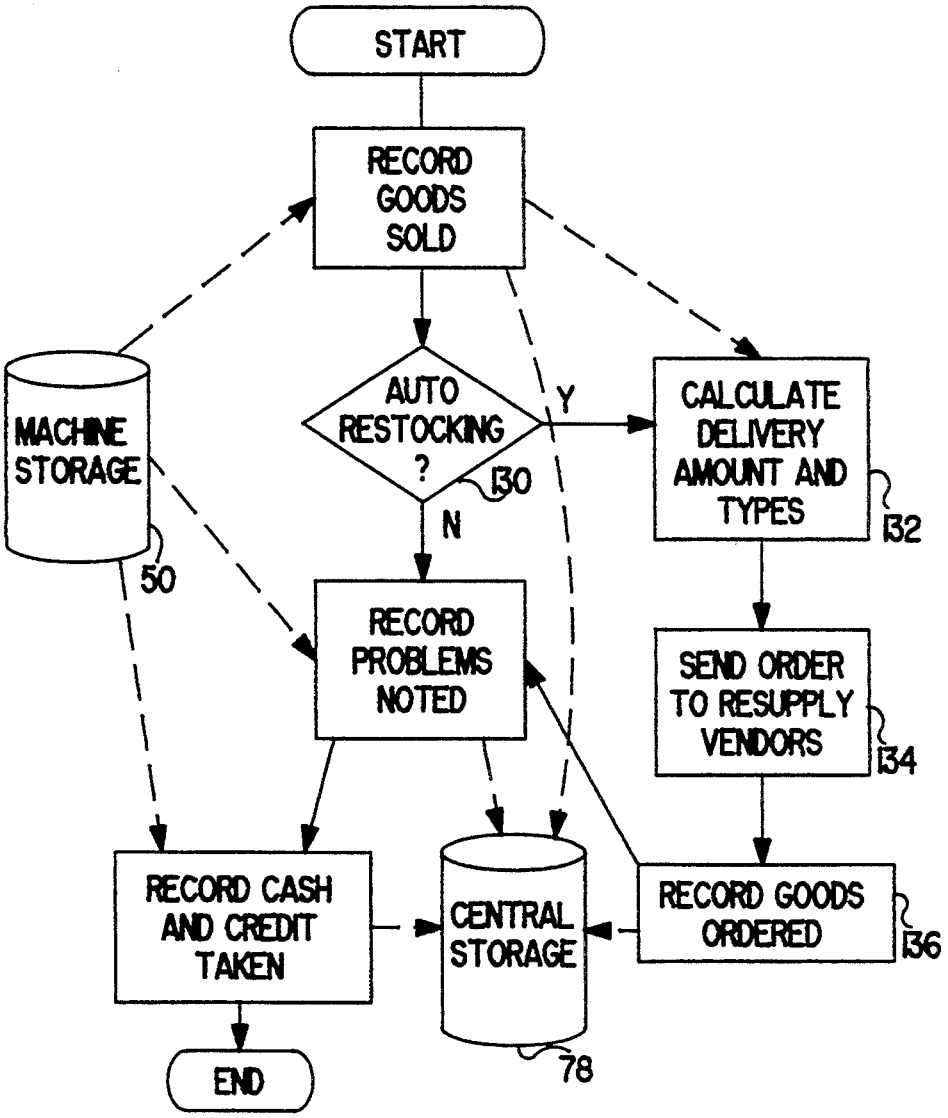
FIG. 7 shows an example flowchart illustrating the logical steps performed by programs in the device during updating and accounting procedures, which might be implemented periodically from a central location.

FIG. 7 illustrates an accounting program suitable for downloading data from the vending machine periodically to a remote, central computer 76, as discussed above. During operation of the program, the data stored by the machine in machine storage 50 are read and transferred to central storage 78, as shown by the dashed lines in FIG. 7.

The accounting program is capable of testing, 130, whether a particular machine has been set for automatic restocking. If it has, the program calculates the types and amounts of products necessary to deliver to the machine's servicing agent, 132, places the order automatically, 134, according to the method described above in connection with FIG. 2, and records, 136, in central storage 78 the amount and type of goods ordered. Several forms of algorithm 132 may be selected, including: (1) a simple replacement system, in which the computer orders an identical quantity of goods purchased in the previous time period, (2) a system that accumulates orders across several machines, to permit placement of a single, composite order or shipment to a central location, or (3) a system that orders only once every several time periods, such as once a week, or sooner when the inventory falls below a preset level. Any of those alternative embodiments can be combined with a predictive algorithm that uses (1) sales data on a number of related machines, (2) the rate of sales coupled with the inventory level, or (3) the frequency of "sold out" indications on other machines to place an order that predict future needs for the particular machine. Such algorithms permit "just-in-time" restocking orders to be placed before the machine shows that it is out of stock.

It is understood by those skilled in the art that numerous alternate forms and embodiments of the invention can be devised without departing from its spirit and scope. Features of the invention deemed novel are set forth below in the claims.

I claim:

1. A machine for automatically vending articles containing recordings, comprising:

(a) storage means for storing within the machine a plurality of types of vended articles, each type separated from the others;

(b) sampling means for displaying at least a portion of a recording associated with at least one of the articles;

(c) means for controlling the type and nature of the display generated by the sampling means;

(d) means for barring access to those controlling means to customers;

(e) selection means for permitting a customer to select at least one desired article;

(f) means for accepting payment from the customer; and (g) dispensing means, coupled to the article storage means, for releasing from the machine selected articles upon receipt of sufficient payment.

2. The apparatus of claim 1 further comprising communication means for sending and receiving data automatically through a telephone line to a remote location.

3. The apparatus of claim 1 in which the sampling means is activated by the payment means.

4. The apparatus of claim 1 in which the sampling means comprises an audio-playback device and at least one speaker.

5. The apparatus of claim 1 in which the sampling means comprises a video-playback device and at least one electronic visual display means.

6. The apparatus of claim 2 in which the communication means comprises storage means for storing sales records and modem means, coupled to the storage means, for transmitting those records through a telephone line.

7. The apparatus of claim 1 in which the sampling means comprises means for displaying a portion of a recording contained in at least one of the articles.

8. A machine for automatically vending articles containing recordings, comprising:

(a) storage means for storing within a machine a plurality of types of vended articles, each separated from the others;

(b) sampling means for displaying at least a portion of a recording contained in at least one of the articles, including a playback device capable of playing audio recordings from a sample recording, a speaker connected to the playback device, and an electronic visual display device:

(c) means for controlling the type and nature of the display generated by the sampling means;

(d) selection means for permitting a customer to select at least one desired article;

(e) means for accepting payment from the customer; and (f) dispensing means coupled to the article storage means for releasing from the machine selected articles upon receipt of sufficient payment.

9. The apparatus of claim 8 further comprising:

(a) memory means, coupled to the payment and dispensing means, for storing sales records; and (b) modem means, coupled to the storage means, for transmitting the stored records through a telephone line.

10. A method of automatically vending articles containing recordings comprising:

(a) storing in a machine a plurality of types of vended articles containing recordings, each type separated from the others;

(b) permitting a customer to select at least one desired article;

(c) displaying at least a portion of the recording contained in at least one of the selected articles;

(d) permitting someone other than a customer to control the type and nature of the display;

(e) accepting payment from the customer; and (f) dispensing selected articles upon receipt of sufficient payment.

11. A system for automatically vending, accounting, and restocking articles comprising:

(a) a plurality of point-of-sale vending machines;

(b) storage means associated with each vending machine for recording information about sales transactions performed by that machine;

(c) communication means associated with each vending machine for transmitting data between the storage means and at least one central location; and (d) central order means for automatically placing orders for the articles in quantities that are functions of data received from the storage means of at least a subset of the vending machines, including means for automatically filling in blanks in a form and means for automatically sending an electronic image of the form by telephone.

12. The system of claim 11 in which the communication means comprises a modem.

13. The system of claim 11 in which the point-of-sale vending machines include at least one machine comprising:

(a) sampling means for displaying at least a portion of a recording contained in at least one of the articles;

(b) selection means for permitting a customer to select at least one desired article;

(c) means for accepting payment from the customer; and (d) dispensing means, coupled to the article storage means, for releasing from the machine selected articles upon receipt of sufficient payment.

14. The system of claim 13 in which the sampling means includes a playback device capable of playing audio recordings from a sample recording, a speaker connected to the playback device, and an electronic visual display device.

15. The method of claim 10 further comprising:

(a) storing sales records in a memory associated with the machine; and (b) transmitting the stored records through a telephone line.

* * * * *